United States Patent [19]

Sasaki et al.

[11] Patent Number: 4,544,263

[45] Date of Patent: Oct. 1, 1985

[54] COPYING MACHINE HAVING AN IMAGE DENSITY CONTROL DEVICE

[76] Inventors: Koji Sasaki, 2-36-14, Hinodai, Hino-shi, Tokyo; Eiichi Yoshida, 2-5-19 Owada-cho, Hachioji-shi, Tokyo; Akira Sawaki, 987, Higashiasakawa-machi, Hachioji-shi, all of Japan

[21] Appl. No.: 549,587

[22] Filed: Nov. 7, 1983

[30] Foreign Application Priority Data

Nov. 25, 1982 [JP] Japan ..... 57-206314

[51] Int. Cl.[4] ..... G03G 15/00

[52] U.S. Cl. ..... 355/14 E; 355/14 D

[58] Field of Search ..... 355/14 D, 14 E, 14 R, 355/3 R, 9

[56] References Cited

U.S. PATENT DOCUMENTS 4,153,364 5/1979 Suzuki et al. ..... 355/14 D 4,239,374 12/1980 Tatsumi et al. ..... 355/14 D

*Primary Examiner*—A. T. Grimley

*Assistant Examiner*—David S. Warren

[57] ABSTRACT

An image density control device for use in an electrophotographic copying machine, employs a scanning light beam having a certain spot size for scanning over a printed original to be copied. Line-width detecting circuitry operates to determine print character line widths on the original according to the output of detecting circuitry on which the light beam reflected from the original impinges. A compensation signal is generated based on the output of the line-width detecting circuitry, to provide a compensation factor based on the ratio of the scanning spot size and the detected line widths. A compensated detected density signal is then produced by compensating circuitry according to the generated compensation signal, and the copy image density is then controlled according to the compensated detected density signal.

3 Claims, 12 Drawing Figures

COPYING MACHINE HAVING AN IMAGE DENSITY CONTROL DEVICE

BACKGROUND OF THE INVENTION

This invention relates to a copying machine having an image density control device, in which the density of a copy image is controlled by detecting the density of an original to be copied.

To begin with, an electrophotographic copying operation is described according to FIG. 1 which shows a general type electrophotographic copying machine, schematically.

In FIG. 1, an original document (not shown) to be copied is placed on a copy board 1 such as glass and is pressed by platen cover 2. When a copy start button (not shown) is operated, an exposure light source 3 is turned on to start scanning in the direction of an arrow A. An image of the original is transmitted to a photosensitive drum 5 which serves as an electrostatic latent image carrier through an optical system 4 comprising a movable first mirror unit 41 having the exposure light source 3, a second mirror unit 42 movable synchronously with the first mirror unit 41, a fixed lens unit 43 and a fixed mirror 44, as per se well known.

The photosensitive drum 5 comprises an electrically grounded metal cylinder having on its outer peripheral surface a photoconductive layer such as selenium or the like, and it rotates in the direction of an arrow synchronously and in a link motion with the exposure scanning motion, of the exposure light source 3 described above. On the photosensitive drum 5, an electrostatic latent image of the original is formed in such a manner that the above-mentioned photoconductive layer is uniformly charged into positive electricity, for example, by a charge electrode 6 which is applied with a DC (Direct Current) high voltage of 5KV; photosensitive drum 5 receives a light image corresponding to the original thereon as optical system 4 is exposure-scanning the original; at this moment the conductivity of a part of the drum exposed to light is increased; the charge in this part escapes to the metal cylinder of the drum; positive charge remains in the dark parts; and thus, an electrostatic latent image corresponding to the original image is formed on the photoconductive layer.

When photosensitive drum 5 further rotates, negative-charged toner is electrostatically attracted from developing unit 7 at the developing station as a result, electrostatic latent image is changed to a visible image or a toner image on the surface, of the drum 5.

Moreover, copy paper is sent out through a pair of feed rollers or resister rollers 10 from a selected cassette stored in paper feed unit 8 with proper timing to keep the front edge of the toner image in line on the drum 5 with the front edge of the copy paper, and the toner on the surface of the drum 5 is then transferred to the copy paper by operation of a transfer electrode 9.

Thereafter, in the case of an electrostatic separation system, for example, the copy paper is separated from photosensitive drum 5 by a separation electrode 11 to which is applied an AC high voltage. The separated copy paper having a toner image is transported to a fixing unit 13, called a roller type fixing unit, generally, the toner image is fixed on the paper when passing the unit. Thereafter, the copy paper is ejected out to a tray (no reference numeral) by rollers 14. There are some instances where, even if a toner image is transferred to a copy paper by transfer electrode 9, a small amount of the toner of the image remains on the surface of the drum 5, therefore, the surface thereof is cleaned up by a cleaning unit having a blade (no reference numeral) of which the lower edge contacts with the surface of the drum, so as to be ready for the next copying process. Copying of an original is thus performed in the above-mentioned cycle.

In a process for controlling the density of a copy image, for example, an original density detector 18 (described hereinafter, see FIG. 8) is provided onto the first mirror unit 41 or the second mirror unit 42 disposed in a space wherein the optical system 4 is movably prepared, and the density of an original to be copied is detected on the copy board by the original density detector when the optical system 4 is preliminarily scanning in the direction of an arrow B (see FIG. 8) by operating the copy start button. In accordance with the detected density the conditions of processes are thereby controlled, such as charging, exposing, developing steps and the like, that is, the substantive copying operation, and thus, a copy paper onto which pattern of the original is copied with a proper density can be obtained.

There normally used an original density detector 18 in wherein a reading spot for reading minute parts of an original is exposed on the original and the detector receives the reflected light therefrom. The original density detector is moved relatively to the original(see FIG. 8, reference numeral 19) so that the reading spot can scan the original. For improving the accuracy of detecting an original density, an important factor is how small is the reading spot area on the original, that is, the area to be detected.

Namely, the smaller the area to be detected is, the more accurate is the density value of the line image density. On the contrary, if the area to be detected is broad, the density value including that of the background surrounding the line image must be detected, so that the detected value becomes lower than the real density value. Therefore the correct line image density value cannot be detected.

Accordingly, such an area to be detected must be as small as the line image density can be correctly detected. However, when a detecting means is constructed so as to make the detection area thereof small, the relationship of the mechanical positions between the detector and an area to be detected i.e., an original surface, must be maintained with a high accuracy, therefore, it becomes difficult to put into practice.

For example, in printing type for news-paper, the most lightface is of the order of 0.10 to 0.15 mm in size. It is therefore difficult to maintain the accuracy of the relationship of the mechanical positions between a detector and an area to be detected if the detection area is made to be a spot of 0.10 mm in width, because a scanning must be made while maintaining the accuracy of the relationship of 0.01 to 0.05 mm. As described above, it has been difficult in a copying machine to detect accurately the density value of a line image original.

OBJECT AND SUMMARY OF THE INVENTION

It is an object of the invention to provide a copying machine having an image density control device which is capable of improving the density detection accuracy even if an area to be detected is broadened enough to the order of the size for practical application.

To attain the above-mentioned object and others of the invention, a copying process is controlled in the manner that a detected density value lowered in accuracy by broadening an area to be detected, is compensated according to the data of a line width given from a signal of the detected density to obtain more accurate density value. The invention is embodied in an electrophotographic copying machine having an image density control device in which a copy density is controlled by detecting an original density. The image density control device comprises density detecting means for detecting the original density, original line-width detecting means for detecting line widths of the original from the output of the density detecting means, compensation signal output means for generating a compensation signal corresponding to the output of the line-width detecting means, compensating means for compensating the output of the density detecting means corresponding to the output of the compensation signal output means, and copy-process controlling means for controlling a copy-image density by the output of the compensating means.

In a preferred embodiment, the copy-process controlling means comprising;

means for storing a density detection frequency which corresponds to each of compensated density values, and means for controlling the copy-image density according to the maximum density and the minimum density obtained from the density range having frequency of not less than a specific frequency selected from the frequency distribution of the density obtained by the storing means.

DETAILED DESCRIPTION OF THE INVENTION

Figure 1:
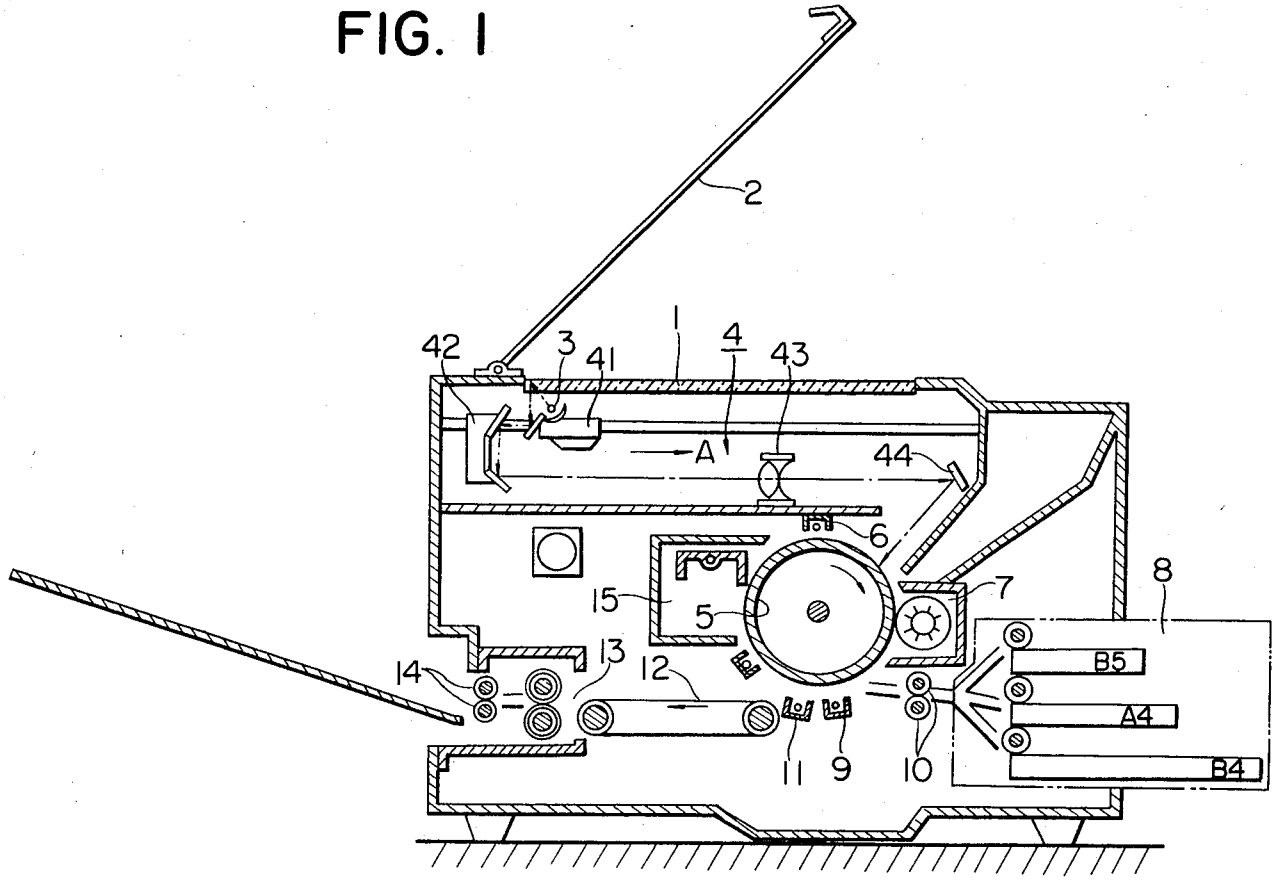
FIG. 1 is a schematic view of an electrophotographic copying machine.
Figure 2:
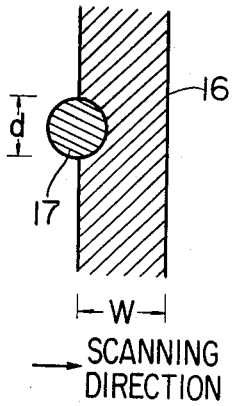
FIG. 2 is a schematic explanatory view showing the relationship between a black-line width W of an original to be copied and diameter d of a reading spot for detecting the density of the black-line according to the present invention.

Scanning of a line image of an original operated by a reading spot of the density of the original to be copied is shown in FIG. 2. A reading spot 17 having the diameter d scans a black-line 16 of the line-width W of an original in the perpendicular direction to the black-line 16, the diameter d of reading spot 17 is fixed and line-width W of black-line 16 is made as a parameter, and thus, detected density DD shows the characteristics shown in FIG. 3. As is apparent from FIG. 3, when W and d are in the relation of $W \geqq d$, detected density DD becomes about 100 per cent of black-level provided that white-level is regarded as 0 per cent. On the other hand, when the relation is $W < d$, the detected density DD lowers as line-width W becomes narrower.

Figure 4:
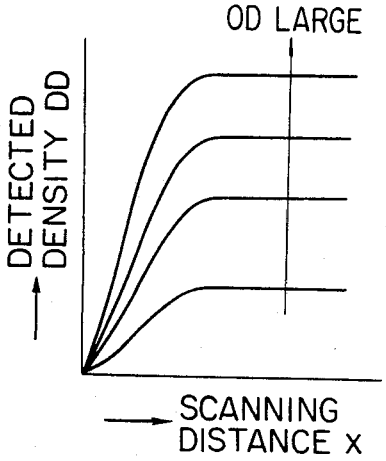
FIG. 4 is an explanatory diagram showing the relationship between scanning distance X of which the parameter is image density OD of the black-line of the original and detected density according to the present invention.

When both diameter d of reading spot 17 and line-width W are fixed, d and W are set in the relation of $d << W$, and the parameter is image density OD of black-line 16, then resulting relation is as shown in FIG. 4.

Figure 5:
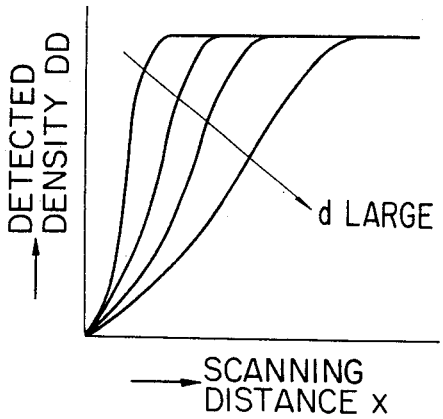
FIG. 5 is an explanatory diagram showing the relationship between scanning distance X of which the parameter is diameter d of a reading spot and detected density DD according to the present invention.

Next, when line-width W is fixed and the parameter is diameter d of reading spot 17, then resulting relation is as shown in FIG. 5. In FIG. 5, the origin at scanning distance x is charged according to diameter d of the reading spot, and W and d is in the relation of $W >> d$.

As described above, diameter d of the reading spot must be smaller than the line-width W if the density of a fine line-width of an original should be more accurately detected.

However, in a reflection type density detector provided with a light emission device and a light, receiving device, when diameter d of a reading spot from a light beam emitted from the light emission device to an original surface is made small, then the distance between the density detector and the original surface must be constantly fixed during the whole period for scanning the original by the density detector, because the diameter d of the reading spot must be kept constant and the distance between the light receiving device and the original surface becomes short.

However, the finest line width of a news paper type or the like is within the order of 0.01 to 0.15 mm. If the width is to be detected more accurately, the diameter d of the reading spot must be not larger than the above-mentioned order. In such cases, accuracy required for parts or assembly between an original density detector and an original surface may be hardly attained.

Figure 3:
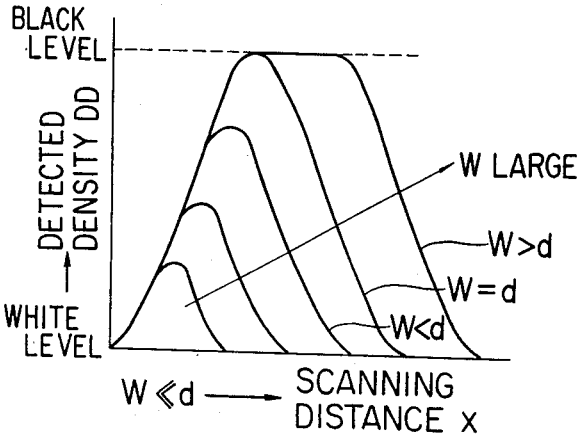
FIG. 3 is an explanatory diagram showing the relationship between scanning distance X of which the parameter is line-width W of the black-line of the original and detected density DD according to the present invention.

Therefore it is considered that the diameter d of the reading spot be made larger. In such cases, the waveform of detected density DD does not reach the original black level at the time when line width W is not wider than the diameter d, as shown in FIG. 3, therefore, the detected density signal is multiplied by a compensation coefficient to increase the density, so that a compensation is made to the essential detection level. To attain this, the data of the line width must be needed, and this data can be obtained from the pulse width of the detected waveform in the case of scanning an orignal by the density detector at a constant velocity v. Namely, such a pulse width Tw is in the relation of $Tw=W/v$.

Figure 6:
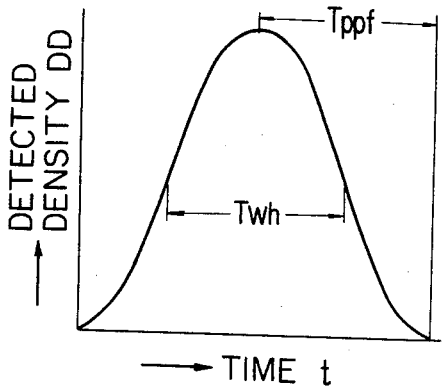
FIG. 6 is a diagram showing a detected density waveform in which the axis of abscissas represents time t and the axis of ordinate represents detected density DD.

The pulse width Tw can be measured in such a manner, as shown in FIG. 6, that time Twh of a half-width, i.e., the width of a level that is one half of the peak-value, of a detected density waveform, or time Tppf from the time reaching the high peak-value to the time reaching the low peak-value, is measured, and then the value thus obtained is doubled.

Figure 7:
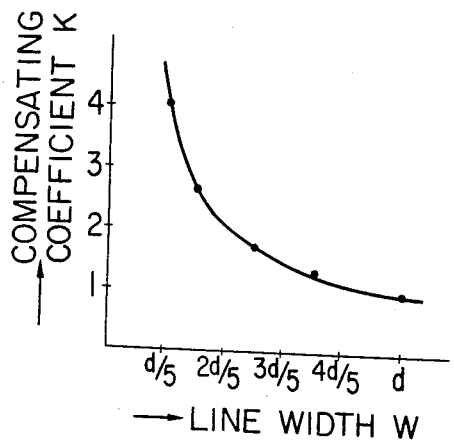
FIG. 7 is a characteristics chart showing the compensation coefficients in which the axis of abscissas represents line width W.

With respect to the relation formula, line-width W is obtained from the pulse width Tw thus obtained, and according thereto, as shown in FIG. 7, a compensation coefficient K is obtained from a compensation curve made to correspond to the diameter of a reading spot to be used, and thereby the high peak-value of a detected density signal is multiplied to obtain an accurate density value.

In FIG. 7, when line-width W is not wider than d/5, it may be considered that compensation coefficient K may become greater so that an error in measurement by a pulse-width Tw detection system affects seriously, and that an electric impulse noise or the like also affects susceptibly. For example, a compensation coefficient may be allowed to be constant when W is narrower than d/5.

Figure 8:
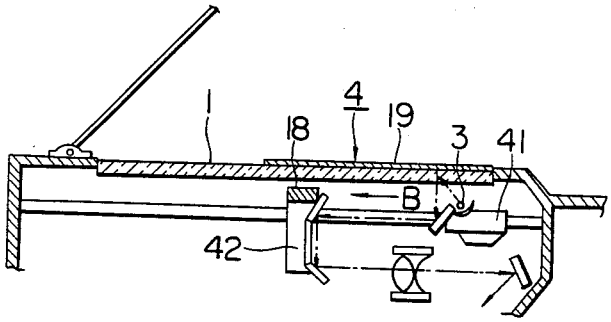
FIG. 8 is schematic cross-sectional view showing an optical system scanning state where an image density detection of the present invention is performed.

FIG. 8 illustrates an example of the invention, wherein original density detector 18 must have a special heat-resistance measure applied when it is in the vicinity of first mirror unit 41, therefore, in this embodiment the density detector is disposed at the second mirror unit 42 so there is no need to apply such measures. The detector is movable in the vertical direction through a proper driven mechanism (not shown). But it is allowable to move the detector in same direction with the second mirror unit, generally. In FIG. 8, an original density is detected during a scanning in the returning direction (shown by arrow B) of optical system 4.

Figure 9:
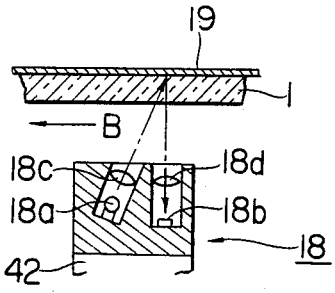
FIG. 9 is a partial cross-sectional view, especially, showing an original density detector of an embodiment of the present invention.

As shown in FIG. 9, original density detector 18 of the reflection type comprises a tungsten lamp 18*a* used as a light emitting element thereof, and a phototransistor 18*b* used as a light receiving element. Condenser lenses 18*c* and 18*d* are mounted on both elements described above, respectively, as one body.

Figure 10:
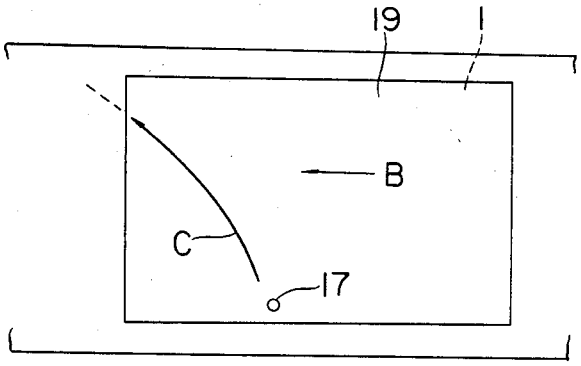
FIG. 10 is a partial cross-sectional view of a copying machine for illustrating how to move a reading spot for detecting an original density.

In this example, original density detector 18 moves in the horizontal direction perpendicular to the direction of an arrow B (normal to the plane of the drawing) simultaneously when second unit 42 mirror moves in the direction of an arrow B. As shown in FIG. 10, during a scanning made by optical system 4 in the direction of an arrow B, reading spot 17 having the diameter of about 1 mm scans in the diagonal direction (indicated by arrow C) an area of original 19 which is put on copy board 1 so as to read a reflected light to a light receiving device from the original surface on which the light beam emitted by original density detector 18 impinges. Thus, the original density of the area scanned by reading spot 17 is detected sequentially.

In this case, letters are usually written in parallel with or in the perpendicular direction to the margin of original 19, therefore, if the original 19 is scanned in the diagonal direction to the original as mentioned above, anyone of the letters will be scanned without fail, so that the image conditions of the original 19 may be accurately detected. At this time, original density detector 18 is some distance from exposure light source 3, therefore when an original 19 is large in size, the scanning covers only a part of the original but the information of the image of the original 19 can be satisfactorily obtained.

The above-mentioned operation is performed by pressing a copy-start button (not shown) in a course of the preliminary scanning prior to an exposure-scanning for copying an original. (In this example, the preliminary scanning is done in a return-scanning by optical system 4.) At this time, the density information of original 19 is detected and then the exposure-scanning for an innate copy is operated by optical system 4 such as exposure light source 3 which scans in the opposite direction of an arrow A to the direction of an arrow B.

Figure 11:
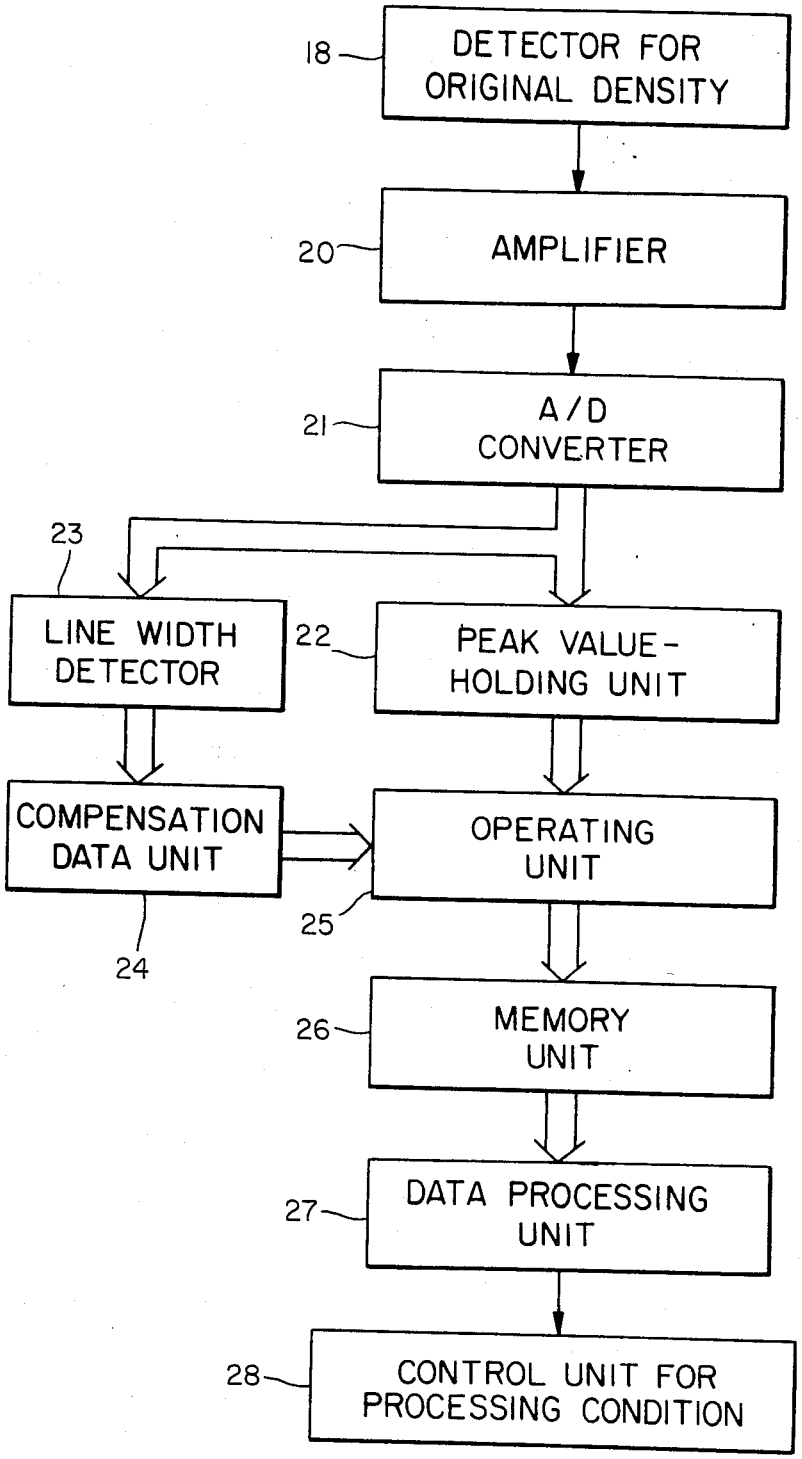
FIG. 11 is a block diagram of a control circuit in an embodiment of the present invention.

When the density of the original 19 is thus detected, the detected density signal is, as shown in FIG. 11, amplified by amplifier 20 and is then converted into a digital signal by A/D converter 21. Then, every peak-value of detected density values are held every time when detected, by peak-value hold unit 22. Furthermore, a line-width is detected by line-width detector 23 based on the aforementioned principle. When the line width data is thus obtained, the data signal is sent to date-compensator 24 and a data signal with compensation coefficient K is therefrom generated to multiply the peak-value of each detected density by the compensation coefficient K, at computing or operating section 25. Thus, a compensated and accurately detected density signal is outputted from the computing section 25.

In the meantime, there are two kinds of image control methods, i.e., one is a process control method in which, among various densities of an original detected, the minimum density thereof is regarded as the background density of the image, or the maximum density thereof is regarded as the image density; and another method is that a frequency distribution shown as a histogram to the density value of an original is obtained and the maximum value in the distribution is detected and is then processed in some statistical process to obtain the original density value.

However, in the former, when an electrical noise, a noise caused by a mechanical vibration or the like is mixed in a density detection signal, the noise is detected as the minimum or maximum density and thereby an erroneous operation may possibly to occur; and in the latter, it is required to raise the sampling frequency to detect a density value accurately. Accordingly, a memory unit for obtaining a frequency distribution cannot help being large in size as well as the processing means thereof.

Figure 12:
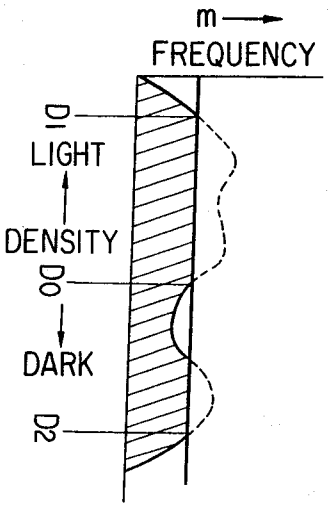
FIG. 12 is a density histogram obtained by detecting an original in accordance with the present invention.

In this example, therefore, a density histogram is obtained, as shown in FIG. 12, by storing and memorizing in memory unit 26 every frequency by density values one after another corresponding to the respective density values each obtained from the above-mentioned density signals.

In the drawing, the characteristics shown by a broken line is that of the actual frequency distribution in which some frequency not less than m is saturated by data processing unit 27. Then, the minimum density $D_1$ and maximum density $D_2$ of this frequency m are detected by data processing unit 27. $D_0$ is the standard of a background density.

When the frequency distribution shown in the histogram of FIG. 12 is obtained in which the minimum density $D_1$ and the maximum density $D_2$ are regarded as the background density and the image (letter or the like) density respectively, processing condition control unit 28 controls copying process conditions such as the exposure conditions by controlling the voltage of exposure light source 3, the development bias conditions by controlling the voltage applied to a sleeve made of non-magnetic and electrically conductive material, as per se well known, of magnetic-brush type developing unit 7, the exposure conditions by controlling the lens-opening of optical system 4, and the like.

When doing this, the detection of a frequency corresponding to each density value may be obtained by detecting whether or not the frequency is not less than a fixed frequency m, therefore, a storage unit necessary for obtaining a frequency distribution may be small in scale, and erroneous operations caused by noises can be reduced because a prescribed frequency or more than that is taken up as a subject.

Next, referring to a concrete example of the image control methods using the maximum density and the minimum density each having frequency of not less than that prescribed from the viewpoint of frequency distribution, H is some specific value.

(a) $D_0 < D_1$—Dark background original (b) $D_0 > D_1, |D_2 - D_1| > H$—Light background and high contrast (c) $D_0 > D_1, |D_2 - D_1| < H$—Light backgound and low contrast Therefore, in the case of (a), a copy density is lowered by increasing exposure and/or by increasing a development bias voltage; in the case of (b), an ordinary exposure and development bias voltage are applied; and in the case of (c), a copy density is increased by decreasing exposure and/or by decreasing a development bias voltage.

In the above example, peak-value holding unit 22, line-width detector 23, compensation data unit 24, computing section 25, storage unit 26 and data processing unit 27 may be replaced altogether by a microcomputer or the like so as to function with the soft-ware of such microcomputer or the like. In this example, the density detector was disposed at second mirror unit 42, however, it can also be disposed at first mirror unit 41. Further in the example, an original density is detected at the time of scanning in the direction of returning to the initial position (i.e., the scanning in the direction of arrow B) after completion of innate scanning an original to be copied. However, it is also possible to perform a preliminary scanning only for detecting an original density over the whole surface of the original or a small part of the surface thereof in the direction of an arrow A that is the same direction as the copy-scanning direction.

According to the invention, the line-width of an original is detected, and a compensation is applied to the detection output of the original density which is read based on the detection signal of the original line-width, therefore, the area of the original to be detected can be broadened when the density thereof is to be detected. Consequently, it is not necessary to control the distance between an original density detecting means and the surface of an original, and to strictly control the variation of the original area to be detected. Further, in the invention, any image density can be detected accurately even if the line-width of such image is fine, and a storage unit for obtaining a frequency distribution at the time of image control may be small enough in scale, and in addition, any influence from noises can also be avoided.

What is claimed is:

1. In an electrophotographic copying machine having an image density control device in which copy density is controlled by detecting an original density, said image density control device comprising:

density detecting means including means for scanning a light beam having a certain scanning spot size over a printed original, for detecting the original print density, original line-width detecting means coupled to an output of said density means for detecting print character line widths of the original from the output of the density detecting means, compensation signal output means coupled to an output of said line-width detecting means for generating a compensation signal based on the output of the line-width detecting means, compensating means coupled to said density detecting means and said compensation signal output means for compensating the output of the density detecting means according to the output of the compensation signal output means and for outputting a corresponding compensated detected density signal, and copy-process controlling means coupled to said compensating means for controlling copy-image density according to the output of the compensating means.

2. The image control means of claim 1, wherein said copy-process controlling means comprises, means for storing a density detection frequency which corresponds to each of compensated density values, and means for controlling the copy-image density according to the maximum density and the minimum density obtained from the density range having frequency of not less than a specific frequency selected from the frequency distribution of the density obtained by the storing means.

3. The image control means of claim 1, wherein said compensation signal output means operates to produce said compensation signal as a function of said scanning spot size and a detected print character line width.

* * * * *